United States Patent [19]

Johnson et al.

[11] 4,241,322

[45] Dec. 23, 1980

[54] COMPACT MICROWAVE FILTER WITH DIELECTRIC RESONATOR

[75] Inventors: Arlen K. Johnson, New Providence; Thomas P. Tignor, Mendham; Theodore K. Wingard, Succasunna, all of N.J.

[73] Assignee: Bell Telephone Laboratories, Incorporated, Murray Hill, N.J.

[21] Appl. No.: 77,925

[22] Filed: Sep. 24, 1979

[51] Int. Cl.[3] ..... H01P 7/10; H01P 1/20

[52] U.S. Cl. ..... 333/202; 333/209; 333/223; 333/227

[58] Field of Search ..... 333/202, 204–205, 333/208–212, 219, 222–226, 245, 248; 331/96, 101

[56] References Cited

U.S. PATENT DOCUMENTS

| | | | |
|---|---|---|---|
| 3,840,828 | 10/1974 | Linn, et al. | 333/205 |
| 3,938,064 | 2/1976 | O'Bryan, Jr. et al. | 333/204 |
| 4,028,652 | 6/1977 | Wakino et al. | 333/209 |
| 4,121,181 | 10/1978 | Nishikawa et al. | 333/202 |
| 4,124,830 | 11/1978 | Ren | 333/209 |
| 4,142,164 | 2/1979 | Nishikawa et al. | 333/227 |
| 4,143,344 | 3/1979 | Nishikawa et al. | 333/219 X |

OTHER PUBLICATIONS

Ehrlich, et al.–"Cell–Site Hardware", *Bell System Technical Journal*, vol. 58, No. 1, Jan. 1979; pp. 153, 174–182.

*Primary Examiner*—Marvin L. Nussbaum
*Attorney, Agent, or Firm*—Thomas Stafford

[57] ABSTRACT

Compactness and substantially optimum electrical performance are realized in a microwave filter incorporating a housing (21, 22) including an interior surface that forms an enclosed cavity having planar cross sections substantially elliptical in shape (FIG. 3). At least one axis of each ellipse monotonically increases in length with perpendicular distance from a first surface (23) toward a second surface (24). A dielectric resonator (11) is positioned in a predetermined relationship within the cavity and at least two terminal members (30,35) extend from outside the housing (21,22) into the cavity. Electromagnetic coupling between the housing (21,22) and the dielectric resonator (11) is minimized to afford substantially optimum electrical performance of the microwave filter.

11 Claims, 8 Drawing Figures

COMPACT MICROWAVE FILTER WITH DIELECTRIC RESONATOR

TECHNICAL FIELD

This invention relates to microwave filters and, more specifically, to compact housings for a dielectric resonator utilized as a microwave filter in a signal translation arrangement such as a frequency multiplexer or demultiplexer.

BACKGROUND OF THE INVENTION

Microwave filters generally are designed to be efficient and compact. Efficiency can be characterized either as low loss or high quality factor. Compact size of the filter is necessary for those applications in which a number of filters are proximately located in a limited space, viz., frequency multiplexers or demultiplexers. Additionally, the filters are designed to minimize interference, such as interresonator coupling, among proximately located filters.

Microwave filters known in the art have been designed using either cavity resonators (see N. Ehrlich et al., "Cell-Site Hardware," *The Bell System Technical Journal,* Vol. 58, Jan., 1979, pp. 153–199), dielectric resonators or the like. Higher quality factors result from the use of dielectric resonators in the microwave filters. Ceramic dielectric resonators made from barium titanate, $Ba_2Ti_9O_{20}$, as shown in U.S. Pat. No. 3,938,064 issued to H. M. O'Bryan, Jr. et al. on Feb. 10, 1976, exhibit higher quality factors than corresponding cavity resonators. Therefore, it appears that the dielectric resonator is a more efficient microwave filter.

Dielectric resonators are excited by electromagnetic radiation at a resonance frequency of the dielectric resonator. Emissions from excited dielectric resonators interfere with and possibly excite other proximately located dielectric resonators. This type of interference phenomenon is called interresonator coupling. Housings, separately enclosing each dielectric resonator and designed to accommodate a particular mode and frequency of electromagnetic propagation, substantially eliminate interresonator coupling. However, these housings can decrease the efficiency of the microwave filter because of electromagnetic coupling between the housing and the excited dielectric resonator.

Prior theoretical electrical optimization of a housing which is electromagnetically coupled to a dielectric resonator normally results in a housing having a prescribed shape. Although this prior housing possesses optimum electrical characteristics, the housing is prohibitively large and impractical for use in applications involving several filters in a limited space. Hence, electrical optimization is in conflict with size reduction of the microwave filter using the dielectric resonator.

In one example, a housing shaped as a right circular cylinder encloses a similarly shaped dielectric resonator, concentrically located within the housing, for supporting a transverse electric propagation mode such as $TE_{01\delta}$. Electrical optimization of a microwave filter incorporating the exemplary housing yields a housing whose diameter is at least twice as large as the diameter of the dielectric resonator. The resulting size of the housing severely restricts the number of microwave filters which can be located in a limited space. Therefore, this electrically optimized microwave filter is impractical for use in applications, where size of the microwave filter is an important criterion, such as frequency multiplexers or demultiplexers.

SUMMARY OF THE INVENTION

Reduced size and substantially optimum electrical characteristics are realized in a microwave filter incorporating a housing including an interior surface that forms an enclosed cavity having planar cross sections substantially elliptical in shape. At least one axis of each elliptical cross section monotonically increases in length with perpendicular distance from a first surface in the cavity. The unique resulting cavity shape yields a compact housing which exhibits substantially optimum electrical characteristics.

In one embodiment of the invention, an interior surface of the housing forms a cavity having substantially flat top and bottom surfaces. A dielectric resonator is positioned in a predetermined relationship within the cavity and at least two terminal members extend from outside the housing into the cavity. Planar cross sections at, between and parallel to the top and bottom surfaces are substantially ellipses. An axis of each successive cross sectional ellipse increases with perpendicular distance from the bottom surface. The resulting combination is a compact, low loss microwave filter. Electromagnetic coupling between the housing and the dielectric resonator is minimized to afford substantially electrically optimum electrical performance of the microwave filter.

BRIEF DESCRIPTION OF THE DRAWING

A more complete understanding of the invention may be obtained from the following detailed description and drawing. In the drawing.

DETAILED DESCRIPTION

Figure 1:
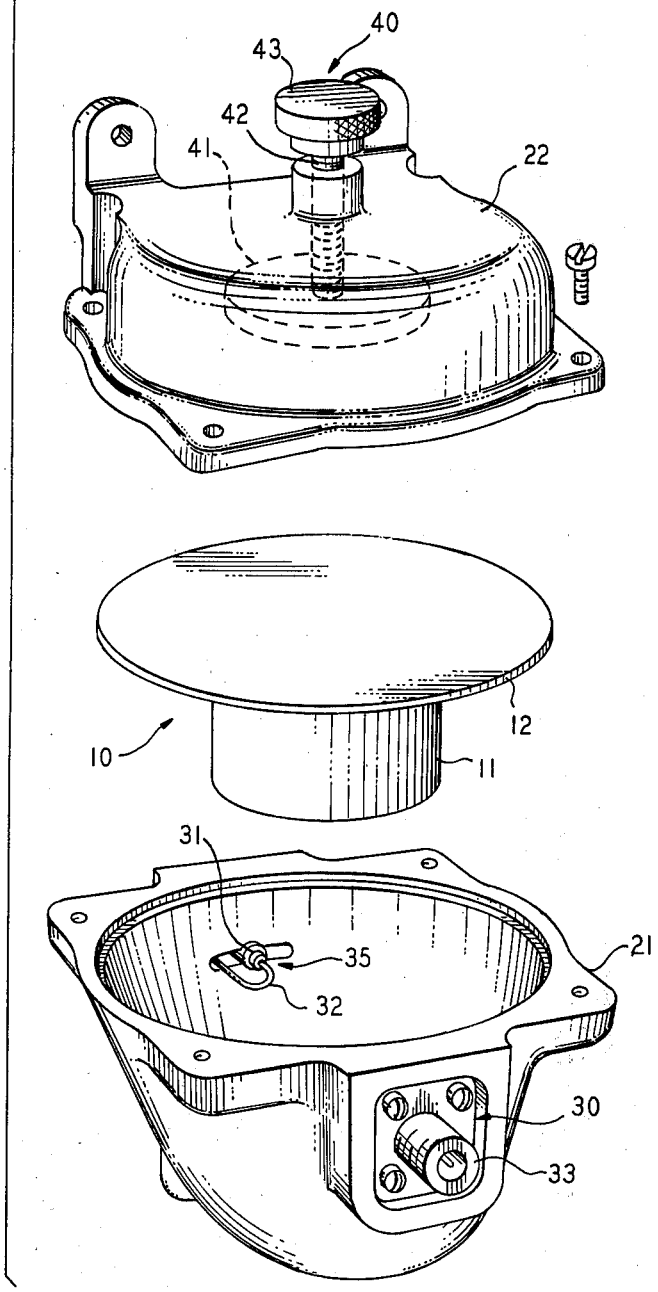
FIGS. 1, 2, and 3 are views of the microwave filter incorporating a dielectric resonator and a housing embodying an aspect of the invention.

FIG. 1 is an exploded perspective view of a microwave filter embodying an aspect of the invention. The microwave filter includes housing sections 21 and 22, dielectric resonator assembly 10, terminal members 30 and 35 and tuner assmebly 40.

Figure 2:
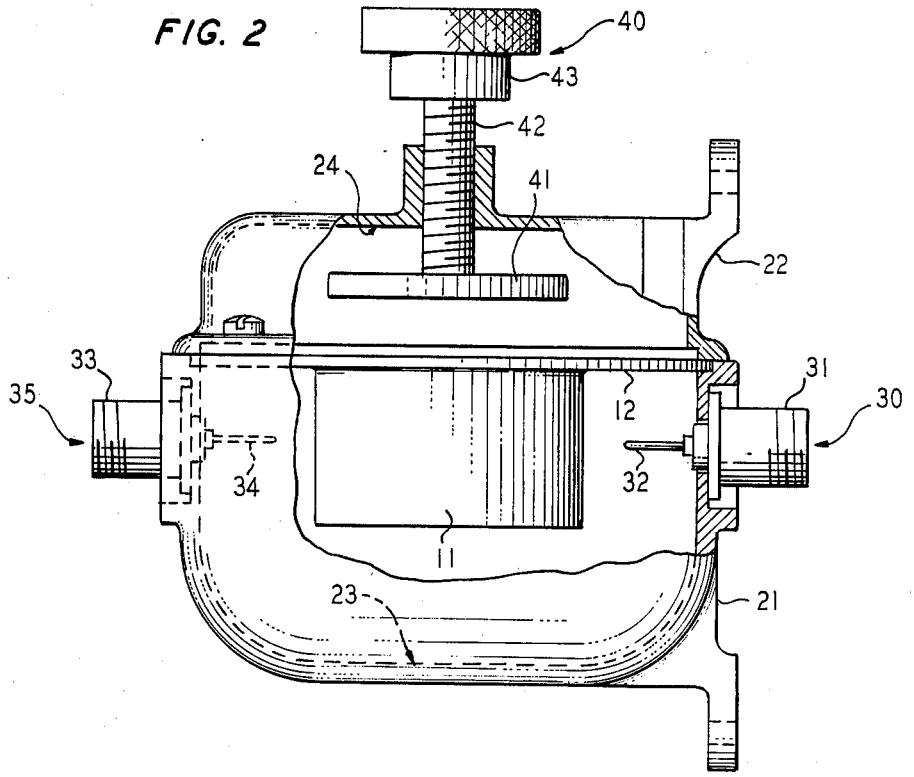

Housing sections 21 and 22, when properly aligned and joined together, form a housing having an interior surface forming an enclosed cavity. The cavity has two substantially flat surfaces parallel to each other, namely, surface 23 (FIG. 2) in housing section 21 and surface 24 (FIG. 2) in housing section 22. Planar cross sections at, parallel to and between surfaces 23 and 24 (FIG. 2) in the cavity are substantially elliptical. Each ellipse has both a major and a minor axis. At least one predetermined axis of each successive ellipse increases monotonically in length with perpendicular distance from surface 23 (FIG. 2). In an example from experimental practice, at least one predetermined axis is the minor axis of each ellipse. Thereby, each elliptical cross section tends more toward a circular shape than elliptical cross sections which are closer to surface 23 (FIG. 2). In the example, when an elliptical cross section become circular, i.e., major and minor axes being substantially equal in length, successive cross sections remain circular. This unique shape results in a compact, microwave filter which has substantially optimum electrical characteristics, i.e., within 0.3 dB of the loss for an optimally designed right circular cylindrical housing enclosing an identical dielectric resonator.

Housing sections 21 and 22 are constructed to have an electrically conductive interior surface. In the example, aluminum is utilized in fabricating housing sections 21 and 22. In another exemplary embodiment, housing sections 21 and 22 are constructed from a plastic material having a conductive material bonded thereon to form the electrically conductive interior surface.

Dielectric resonator 11 is a block of dielectric material having at least two planar surfaces parallel to surfaces 23 and 24 (FIG. 2) of the cavity. In an example from experimental practice, dielectric resonator 11 is a ceramic material such as $Ba_2Ti_9O_{20}$ as shown in the aforementioned H. M. O'Bryan, Jr. et al. reference. Dielectric resonator 11, as illustrated in FIG. 1, is constructed as a right circular cylinder. This shape is desirable for supporting propagation of particular transverse electric modes, such as $TE_{01\delta}$, of the resonance frequencies for dielectric resonator 11 used in experimental practice in the microwave filter. $TE_{01\delta}$ is the lowest order cylindrical mode.

Actual dimensions for dielectric resonator 11 are derived by known techniques upon selection of a particular resonance frequency, filter tuning range and electromagnetic mode. In the example, a diameter to height ratio for dielectric resonator 11 is approximately 2 to 1 for supporting resonance frequencies over the frequency range 880 MHz$\pm$10 MHz in $TE_{01\delta}$ mode. It is clear that the dimensions of dielectric resonator 11 are interrelated with the dimensions of housing sections 21 and 22. In particular, interior surface dimensions of housing sections 21 and 22 are selected to minimize loss introduced by electromagnetic coupling between housing sections 21 and 22 and dielectric resonator 11 while maintaining a compact size for the microwave filter.

Dielectric resonator 11 is mounted on and supported by substrate 12 to form dielectric resonator assembly 10. Substrate 12 is a material of low conductivity (low dielectric constant) or, preferably, nonconductivity. Epoxy is used to attach dielectric resonator 11 in position on substrate 12. Mounting dielectric resonator 11 on substrate 12 insures proper spatial relation of dielectric resonator 11 with respect to at least surfaces 23 and 24 (FIG. 2) of the cavity. The two parallel planar surfaces of dielectric resonator 11 are held by substrate 12 parallel to surfaces 23 and 24 (FIG. 2) of the cavity. In the example, the outer cylindrical surface of dielectric resonator 11 is centrally located in the cavity and equidistant from terminal members 30 and 35 in order to insure an optimum power transfer between terminal members 30 and 35 of the microwave filter.

Terminal members 30 and 35 are input/output ports for the microwave filter. Both terminal members 30 and 35 extend from outside housing section 21 into the cavity and are located on opposite sides of housing section 21. Connector 31 and terminal loop 32 form terminal member 30 and connector 33 and terminal loop 34 (FIG. 2) form terminal member 35. Connectors 31 and 33 allow for electrical connections to be made to the microwave filter. A center conductive terminal (not shown) in each of connectors 31 and 33 is electrically insulated from housing section 21 and from each of connectors 31 and 33. Each of terminal loops 32 and 34 (FIG. 2) is connected between housing section 21 and the center conductive terminal of connectors 31 and 33, respectively. In an example from experimental practice, coaxial connectors have been used for connectors 31 and 33. Also, terminal loops 32 and 34 (FIG. 2) each form elongated semicircular loops extending into the cavity. The size and shape of terminal loops 32 and 34 (FIG. 2) are related to the particular electromagnetic mode, such as $TE_{01\delta}$, selected for the microwave filter and insure optimum power transfer between terminal members 30 and 35.

Dielectric resonator 11 has a frequency response characteristic centered about its resonance frequency given a particular electromagnetic mode of operation. Tuner assembly 40 included in housing section 22 provides a means for shifting the center frequency of the frequency response characteristic away from the resonance frequency. In the example from experimental practice, dielectric resonator 11 has a resonance of 870 MHz and is tunable over the frequency range 880 MHz$\pm$10 MHz.

Tuning plate 41, shaft 42 and knob 43 comprise tuner assembly 40. Shaft 42 extends from outside housing section 22 into the cavity and is connected to tuning plate 41 and to knob 43 for ease in making tuning adjustments. Shaft 42 is slidable through an aperture in housing section 22 to displace tuning plate 41 toward or away from dielectric resonator 11. Tuning plate 41 is a metallic disc having planar surfaces parallel to the planar surfaces of dielectric resonator 11. In experimental practice, tuning plate 41 and dielectric resonator 11 have approximately equal diameters. However, the diameter of tuning plate 41 may extend to the interior physical limits of the cavity formed within housing section 22.

In operation, as tuning plate 41 is displaced toward dielectric resonator 11, the frequency response characteristic is shifted to a position about a center frequency higher than the resonance frequency of dielectric resonator 11. It should be apparent to one skilled in the art that a nontunable or fixed frequency microwave filter is realized by elimination of the tuner assembly in housing section 22 along with judicious selection of perpendicular distance from surface 24 (FIG. 2) of the cavity to a closest planar surface of dielectric resonator 11. In a tunable microwave filter arrangement, tuning plate 41 functions in an analogous manner to surface 24 (FIG. 2) of the cavity in a nontunable microwave filter because it interacts directly with the electromagnetic fields emanating from dielectric resonator 11.

FIG. 2 is a cutaway view of the microwave filter shown in FIG. 1. Parallel relationships between planar surfaces of dielectric resonator 11, plate 41 and surfaces 23 and 24 of the cavity are apparent. Further, terminal loops 32 and 34 are substantially coplanar and parallel to the planar surface of dielectric resonator 11.

Figure 3:
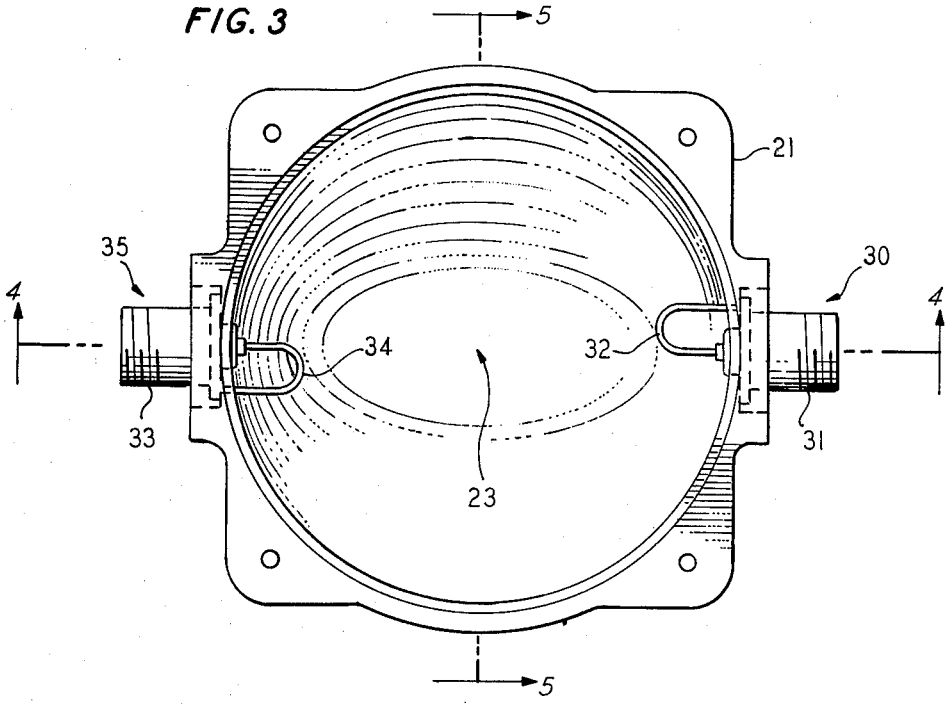

FIG. 3 illustrates the elliptical shape of successive cross sections of the cavity extending perpendicularly away from surface 23 of the cavity. This unique shape provides a compact, microwave filter while minimizing the loss introduced by electromagnetic coupling between dielectric resonator 11 (FIGS. 1 and 2) and housing section 21 and 22. Two cuttng planes, plane 4—4 and plane 5—5, directionally indicate views through housing section 21. Plane 4—4 is along the major axis of each ellipse and plane 5—5 is along the minor axis.

Figure 4:
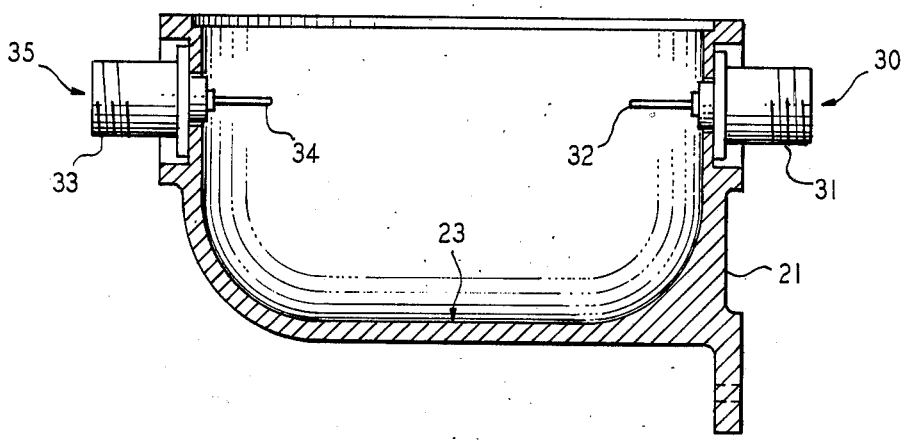
FIG. 4 is a fragmentary view of a portion of the microwave filter embodying an aspect of the invention taken at the plane 4—4 in the direction of the arrows shown in FIG. 3.
Figure 5:
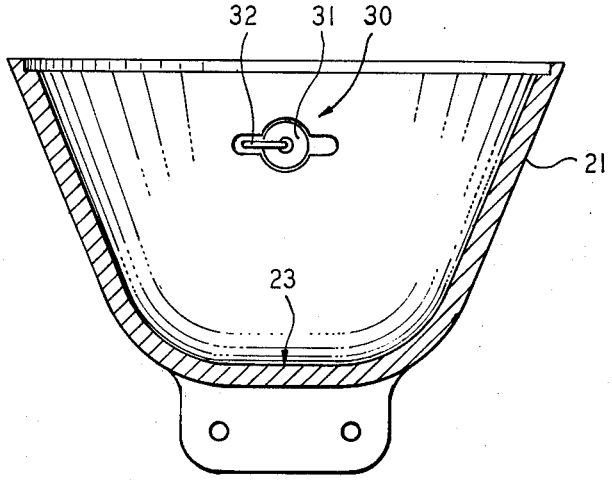
FIG. 5 is a fragmentary view of a portion of the microwave filter embodying an aspect of the invention at the plane 5—5 in the direction of the arrows as shown in FIG. 3.

Fragmentary views of housing section 21 taken atcutting planes 4—4 and 5—5 are shown in FIGS. 4 and 5, respectively. In FIG. 5, the minor axis of each ellipse monotonically increases in length with perpendicular distance from surface 23 to surface 24.

Frequency multiplexers/demultiplexers are an important application for the compact, low loss microwave filter utilizing the present housing. Frequency multiplexers or demultiplexers utilize an arrangement for translating signals between a wideband channel and a number of narrowband channels. Each narrowband channel occupies a mutually exclusive band of frequencies within the wideband channel. In the frequency multiplexer application, a microwave filter tuned to a center frequency in each mutually exclusive band of frequencies shapes an input signal from the narrowband channel. In the frequency demultiplexer, the microwave filter extracts the narrowband channel signal from other signals on the wideband channel.

Figure 6:
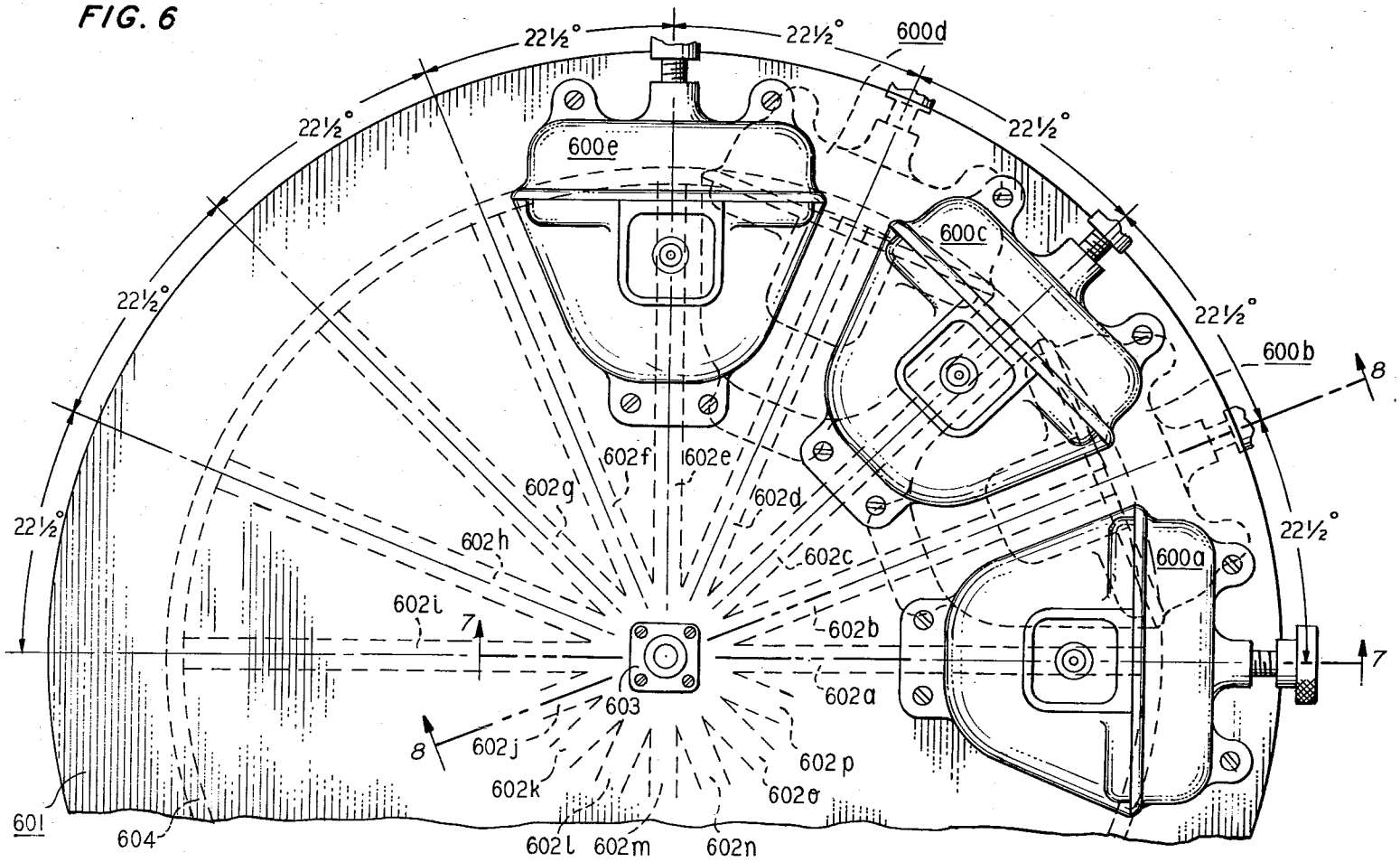
FIGS. 6, 7, and 8 are views of a multiplexer arrangement embodying an aspect of the invention.

FIG. 6 is a partial view of a signal translation arrangement, i.e., frequency multiplexer or frequency demultiplexer, including sixteen compact, low loss microwave filters embodying an aspect of the invention. Five compact, low loss microwave filters 600*a–e* are shown in FIG. 6. These filters have been described earlier in the detailed description and shown in FIGS. 1 through 5. The signal translation arrangement includes filters 600*a–p* (filters 600*f–p* not shown), signal translator disc 601, and common terminal 603.

Figure 7:
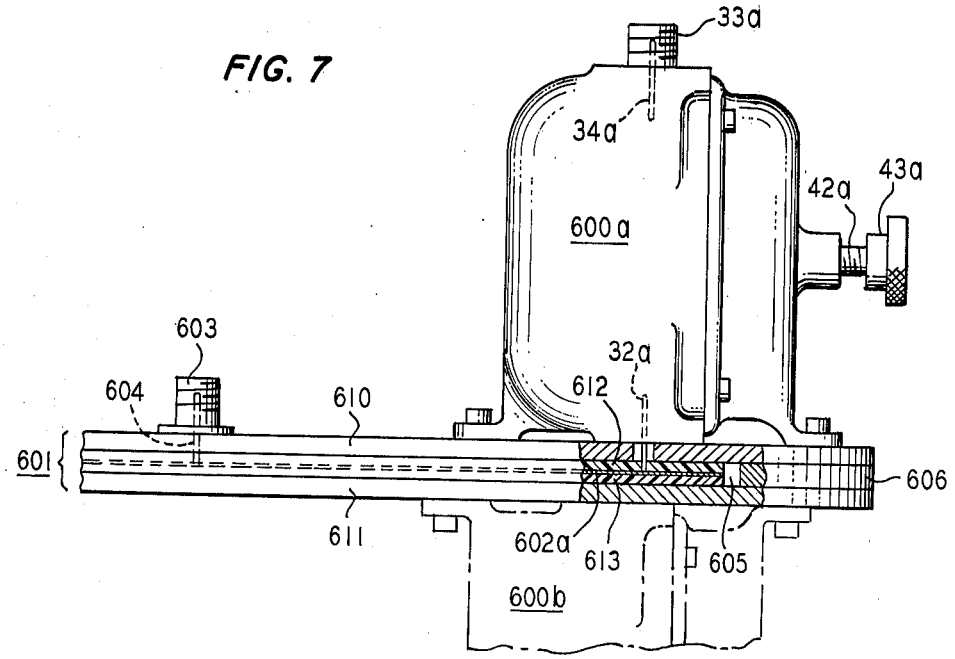

The wideband channel signal is present at common terminal 603. Narrowband channel signals are present at the terminal members of each microwave filter 600*a–p*, (filters 600*f–p* not shown), for example, at connector 33*a* in filter 600*a* (FIG. 7). Signal translator disc 601 conductively connects a terminal member in each filter 600*a–p* (filters 600*f–p* not shown) to common terminal 603.

Figure 8:
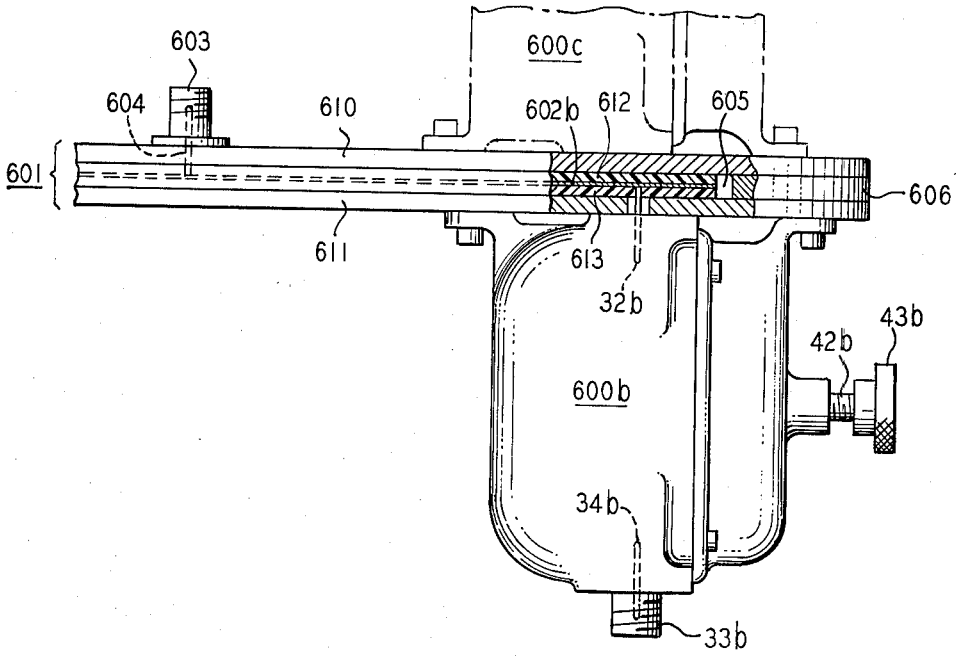

Cutting planes 7—7 and 8—8 are shown in FIG. 6. FIGS. 7 and 8 are composite sections taken at cutting planes 7—7 and 8—8, respectively, in FIG. 6.

Signal translator disc 601, in one embodiment, is a flat or planar multilayer circular disc. Filters 600*a–p* (filters 600*f–p* not shown) are arranged on and supported by signal translator disc 601. In the embodiment shown in FIG. 6, 7 and 8, eight filters are arranged and supported on an obverse side of signal translator disc 601 and the remaining eight filters are arranged and supported on a reverse side of signal translator disc 601.

Strip connectors 602*a–p* (FIG. 6), signal translator disc layers 610, 611, 612, and 613, and spacer 606 are included in signal translator disc 601. Layers 610 and 611 are made from a conductive metallic material and are used as a common potential or ground plane for filters 600*a–p* on signal translator disc 601. Layers 612 and 613 are made from a nonconductive material and are used as carriers for metallic strip connectors 602*a–p* (FIG. 6). In an example from experimental practice, layers 610, 611, 612 and 613 are circular. The diameters of layers 610 and 611 are substantially equal and are greater than the diameters of layers 612 or 613 which are also substantially equal. Spacer 606 is a circular ring having an outer diameter approximately equal to the diameter of either layer 610 or 611 and having an inner diameter larger than the diameter of either layer 612 or 613. Spacer 606 is generally used to support outer portions of signal translator disc 601. Air gap 605 is an additional insulation medium between strip connectors 602*a–p* (FIG. 6) and spacer 606.

Illustratively, strip connectors 602*a–p* (FIG. 6) are disposed on either layer 612 or layer 613 or layers 612 and 613. In one technique, a metallic coating is selectively etched off a planar surface of layer 612 to form strip connectors 602*a* (FIG. 7), and 602*c, e, g, i, k, m,* and *o* (FIG. 6). Similarly, a metallic coating selectively etched off a planar surface of layer 613 forms strip connectors 602*b* (FIG. 8), and 602*d, f, h, j, l, n* and *p* (FIG. 6). Upon assembly into signal translator disc 601, strip connectors 602*a–p* are substantially coplanar at an innermost surface of multilayer signal translator dics 601.

In the example as shown in FIG. 7, terminal loop 32*a* in filter 600*a*, insulated from the housing of filter 600*a* and from layer 610, is connected to strip connector 602*a* on layer 612 at an innermost surface of signal translator disc 601. Similarly, but not shown, terminal loops 32*c, e, g, i, k, m* and *o* in filters 600*c, e, g, i, k, m* and *o*, respectively, each insulated from their respective filter housings and from layer 610, are connected separately to strip connectors 602*c, e, g, i, k, m* and *o*, respectively, on layer 612 at the innermost surface of signal translator disc 601. In FIG. 8, a connection of terminal loops 32*b in filter 600b* to strip connector 602*b* on layer 631 at an innermost surface of signal translator disc 601 corresponds to similar connections described above. Similarly, but not shown, terminal loops 32 *d, f, h, j, l, n* and *p* are connected to strip connectors 602*d, f, h, j, l, n* and *p* on layer 613 at an innermost surface of signal translator disc 601.

Common terminal 603 includes center conductor 604 insulated from common terminal 603. Center conductor 604 (FIGS. 7 and 8) connected to an end of each strip connector 602*a*p is a common terminus for connections to each filter 600*a–p*. The length of each strip connector 602*a–p* and its corresponding terminal loop 32*a–p* is selected to optimize power transfer from each terminal loop 34*a–p* to common terminal 603. In an example from experimental practice, the length of each strip connector 602*a–p* and its corresponding terminal loop 32*a–p* is an odd-multiple quarter wavelength, e.g., three-quarter wavelength, of a predetermined frequency. One predetermined frequency is the center frequency of the wideband channel. In one application, the wideband channel extends from 870–890 MHz with a center frequency of 880 MHz. Therefore, the length of each strip connector 602*a–p* is derived from three-quarters of the wavelength of 880 MHz.

In the arrangement shown in FIGS. 6, 7, and 8, filters 600*a–p* include ceramic ($Ba_2Ti_9O_{20}$) dielectric resonators and tuner assemblies for tuning each filter 600*a–p* to a particular narrowband channel within the wideband channel of interest.

It is apparent to those skilled in the art that the use of sixteen filters is only illustrative and not limiting to the number of filters or channels used in another embodiment of a signal translation arrangement.

We claim:

1. Apparatus adaptable for use as a microwave filter comprising a housing (21, 22) having an electrically conductive interior surface forming an enclosed cavity, the cavity extending from a substantially flat first surface (23) to a substantially flat second surface (24), a dielectric resonator (11) having planar surfaces parallel to the first (23) and second (24) surfaces of the cavity and positioned in predetermined spatial relationship in the cavity adapted to support a transverse electric mode of its resonance frequencies, and input (35 or 30) and output (30 or 35) terminal members extending from outside the housing (21, 22) into the cavity and being electrically insulated from the housing for transferring electromagnetic energy to and from the dielectric resonator (11), characterized by, the interior surface of the housing (21, 22) forming an enclosed cavity having a plurality of planar cross sections (FIG. 3) at and between the first (23) and second (24) surfaces and parallel to the first surface (23), each being substantially an ellipse having a first and second axis, and at least one of the axes of each successive ellipse monotonically increasing in length with perpendicular distance from the first surface (23), the apparatus having substantially optimum electrical characteristics.

2. Apparatus as defined in claim 1 wherein the housing (21, 22) is further characterized by, a first housing section (21) having an interior surface forming a cavity, the cavity extending from a substantially flat first surface (23) to a first planar aperture, and a second housing section (22) having an interior surface forming a cavity, the cavity extending from a substantially flat second surface (24) to a second planar aperture, the first and second axes of th ellipses in each of the cross sections of the first and second planar apertures being substantially equal.

3. Apparatus as defined in claim 1 further characterized by support means (12) having a low dielectric constant for holding the dielectric resonator (11) in the predetermind spatial relation in the cavity.

4. Apparatus as defined in claim 1 wherein the terminal members (30, 35) each include elongated semicircular loops (32, 34) within the cavity, each loop (32, 34) positioned to optimize power transfer between the terminal members (30, 35).

5. Apparatus as defined in claim 1 wherein the dielectric resonator (11) is ceramic.

6. Apparatus as defined in claim 5 wherein the ceramic is $Ba_2Ti_9O_{20}$.

7. Apparatus adaptable for use as a tunable microwave filter comprising a housing (21, 22) having an electrically conductive interior surface forming an enclosed cavity, the cavity extending from a substantially flat first surface (23) to a substantially flat second surface (41), a dielectric resonator (11) having planar surfaces parallel to the first (23) and second (41) surfaces and positioned in predetermined spatial relationship in the cavity adapted to support a transverse electric mode of its resonance frequencies, and input (35 or 30) and output (30 or 35) terminal members extending from outside the housing (21, 22) into the cavity and being electrically insulated from the housing for transferring electromagnetic energy to and from dielectric resonator (11), characterized by, means (42, 43) for displacing the second surface (41) toward or away from the first surface (23) while maintaining the second surface (41) in parallel relationship with the planar surfaces of the dielectric resonator (11), and the interior surface of the housing (21, 22) forming an enclosed cavity having a plurality of planar cross sections (FIG. 3) at and between the first (23) and second (41) surfaces and parallel to the first surface (23), each planar cross section of the cavity is substantially an ellipse having first and second axes, the first axis of each successive ellipse monotonically increasing in length with perpendicular distance from the first surface (23) the apparatus having substantially optimum electrical characteristics.

8. Apparatus as defined in claim 7 wherein the terminal members (30, 35) each include elongated semicircular loops (32, 34) within the cavity, each loop (32, 34) positioned to optimize power transfer between the terminal members (30, 35).

9. Apparatus as defined in claim 7 further characterized by support means (12) having a low dielectric constant for holding the dielectric resonator (11) in predetermined spatial relation in the cavity.

10. Apparatus as defined in claim 7 wherein the dielectric resonator (11) is ceramic.

11. Apparatus as defined in claim 10 wherein the ceramic is $Ba_2Ti_9O_{20}$.

* * * * *